US007841972B1

(12) United States Patent
Huang et al.

(10) Patent No.: US 7,841,972 B1
(45) Date of Patent: Nov. 30, 2010

(54) DUMBBELL

(75) Inventors: Hsuan Fu Huang, Taipei (TW); Ming Nan Chen, Taipei (TW)

(73) Assignee: Michael Lin, Taipei (TW)

( * ) Notice: Subject to any disclaimer, the term of this patent is extended or adjusted under 35 U.S.C. 154(b) by 0 days.

(21) Appl. No.: 12/587,356

(22) Filed: Oct. 7, 2009

(51) Int. Cl.
*A63B 21/072* (2006.01)
*A63B 23/16* (2006.01)
*A63B 5/20* (2006.01)
*A61H 1/00* (2006.01)

(52) U.S. Cl. ..... 482/108; 482/50; 482/82; 601/72

(58) Field of Classification Search ..... 482/6–109, 482/139, 148; 601/72, 62–63, 73
See application file for complete search history.

(56) References Cited

U.S. PATENT DOCUMENTS 818,242 A * 4/1906 Geisel ..... 482/128
1,416,741 A * 5/1922 Nicholls et al. ..... 482/129
1,956,498 A * 4/1934 Duke ..... 482/126
2,920,418 A * 1/1960 Britt ..... 446/241
3,544,106 A * 12/1970 Barrett ..... 482/126
3,741,539 A * 6/1973 Hutchins et al. ..... 482/126
3,756,597 A * 9/1973 Monti ..... 482/106
3,761,083 A * 9/1973 Buchner ..... 482/126
3,938,803 A * 2/1976 Wilmoth et al. ..... 482/132
4,037,839 A * 7/1977 Nelson ..... 463/47.7
4,111,417 A * 9/1978 Gardner ..... 482/128
4,274,631 A * 6/1981 Hayazaki ..... 473/457
4,433,683 A * 2/1984 McCoy et al. ..... 601/120
4,600,190 A * 7/1986 Berokoff ..... 482/129
4,695,049 A * 9/1987 Ciemiega ..... 482/46
4,775,149 A * 10/1988 Wilson ..... 482/126
4,801,137 A * 1/1989 Douglass ..... 482/82
4,913,417 A * 4/1990 Francu ..... 482/45
4,978,122 A * 12/1990 Dibowski ..... 482/106
5,242,349 A * 9/1993 Reiff et al. ..... 482/106
5,334,118 A * 8/1994 Dantolan ..... 482/93
5,474,511 A * 12/1995 Dantolan ..... 482/93
5,868,653 A * 2/1999 Klasen ..... 482/110
5,879,274 A * 3/1999 Mattox ..... 482/107
6,328,680 B1 * 12/2001 Shifferaw ..... 482/132
6,537,183 B1 * 3/2003 McCrea ..... 482/106
6,544,148 B1 * 4/2003 Loew ..... 482/82
7,462,140 B1 * 12/2008 Lombardozzi ..... 482/82
2008/0070764 A1 * 3/2008 Amzallag et al. ..... 482/129

* cited by examiner

*Primary Examiner*—Loan Thanh
*Assistant Examiner*—Robert F Long
(74) *Attorney, Agent, or Firm*—Charles E. Baxley

(57) ABSTRACT

A dumbbell includes a handle, a weight unit and two caps for retaining the weight unit within the handle. The weight unit includes weights and springs alternately arranged within the handle. Each of the caps is located against a related one of the springs so that the weights do not hit the handle axially.

13 Claims, 12 Drawing Sheets

DUMBBELL

BACKGROUND OF INVENTION

1. Field of Invention

The present invention relates to a dumbbell and, more particularly, to a dumbbell including a selective amount of weights in a handle.

2. Related Prior Art

There are many exercise machines with which people exercise different muscles. Many of the exercise machines are only suitable for use in gyms but not suitable for use at home for being bulky. For people who cannot manage to have time to work out with exercise machines in gyms and have space to accommodate exercise machines at home, dumbbells are a good choice.

There are constant-weight dumbbells each made with constant weight. A person may use light dumbbells when he or she initiates an exercise program. After executing the exercise program for some time, the person may become stronger and need heavy dumbbells. The light dumbbells become redundant.

There are variable-weight dumbbells each including a handle, a variable amount of weights and two nuts for retaining the weights on the handle. A person may use a small amount of weights when he or she initiates an exercise program. After executing the exercise program for some time, the person may become stronger and need more weights. At least one serious problem is however encountered during the use of the variable-weight dumbbells. The weights often rattle on the handles as the nuts get loose on the handles. Annoying noise is made.

The present invention is therefore intended to obviate or at least alleviate the problems encountered in prior art.

SUMMARY OF INVENTION

It is the primary objective of the present invention to provide a dumbbell with a weight unit in a handle.

To achieve the foregoing objective, the weight unit includes weights and springs alternately arranged within the handle. Two caps are connected to the handle, thus retaining the weights and springs within the handle. Each of the caps is located against a related one of the springs so that the weights do not hit the handle axially.

Other objectives, advantages and features of the present invention will become apparent from the following description referring to the attached drawings.

BRIEF DESCRIPTION OF DRAWINGS

The present invention will be described via detailed illustration of three embodiments referring to the drawings.

DETAILED DESCRIPTION OF EMBODIMENTS

Figure 1:
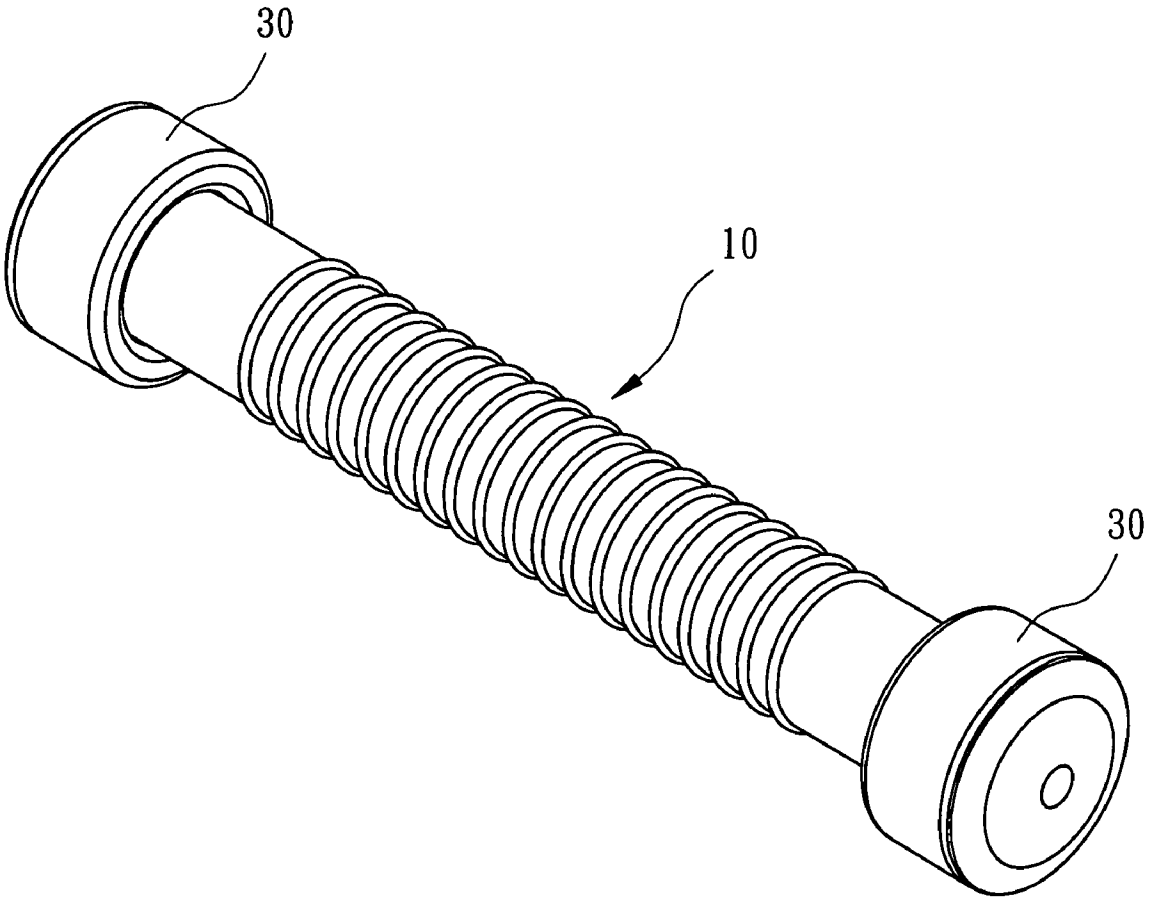
FIG. 1 is a perspective view of a dumbbell according to the first embodiment of the present invention.
Figure 2:
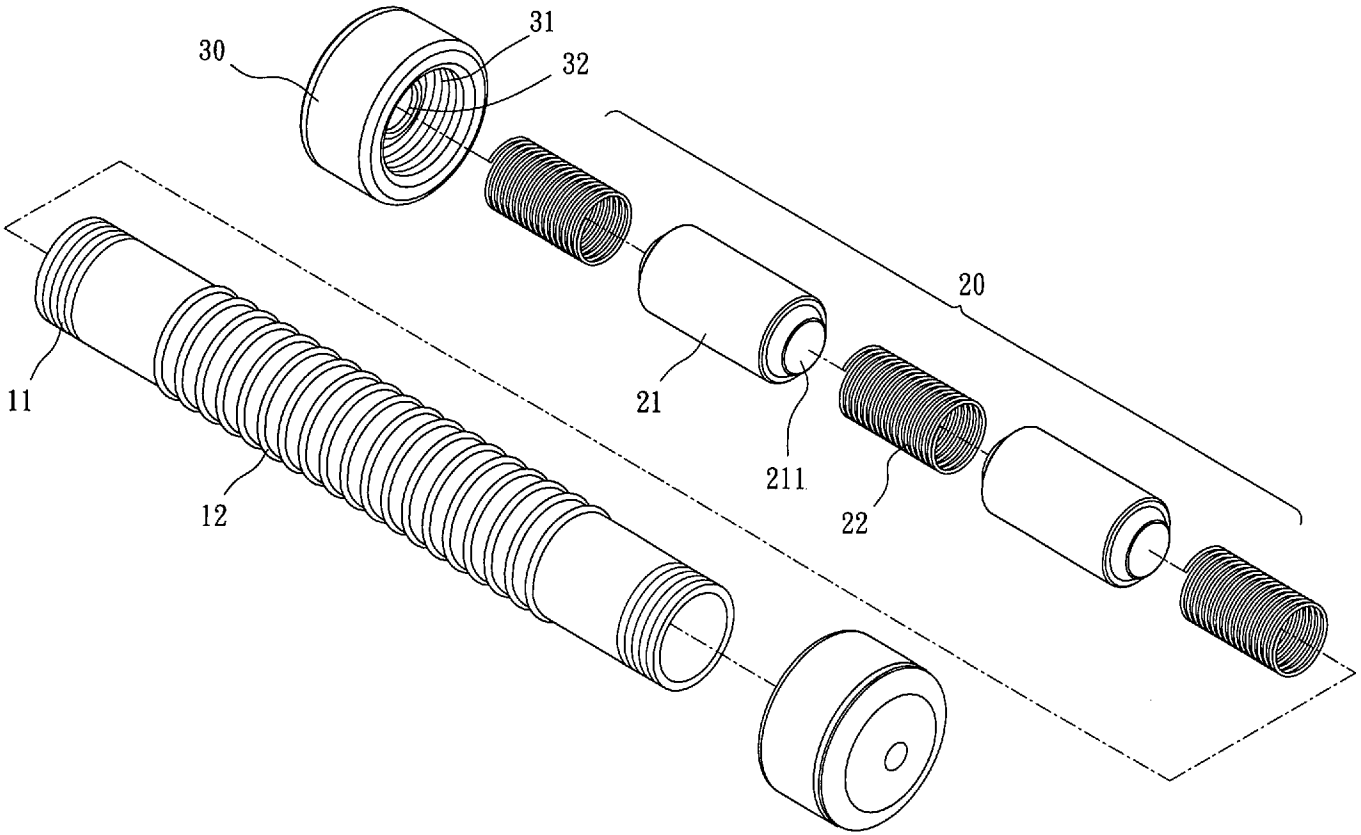
FIG. 2 is an exploded view of the dumbbell shown in FIG. 1.

Referring to FIGS. 1 and 2, a dumbbell includes a handle 10, a weight unit 20 and two caps 30 for retaining the weight unit 20 within the handle 10 according to a first embodiment of the present invention. The handle 10 is hollow inside and formed with two threads 11 and skid-proof ribs 12 on the outside. The ribs 12 are located between the threads 11.

Figure 3:
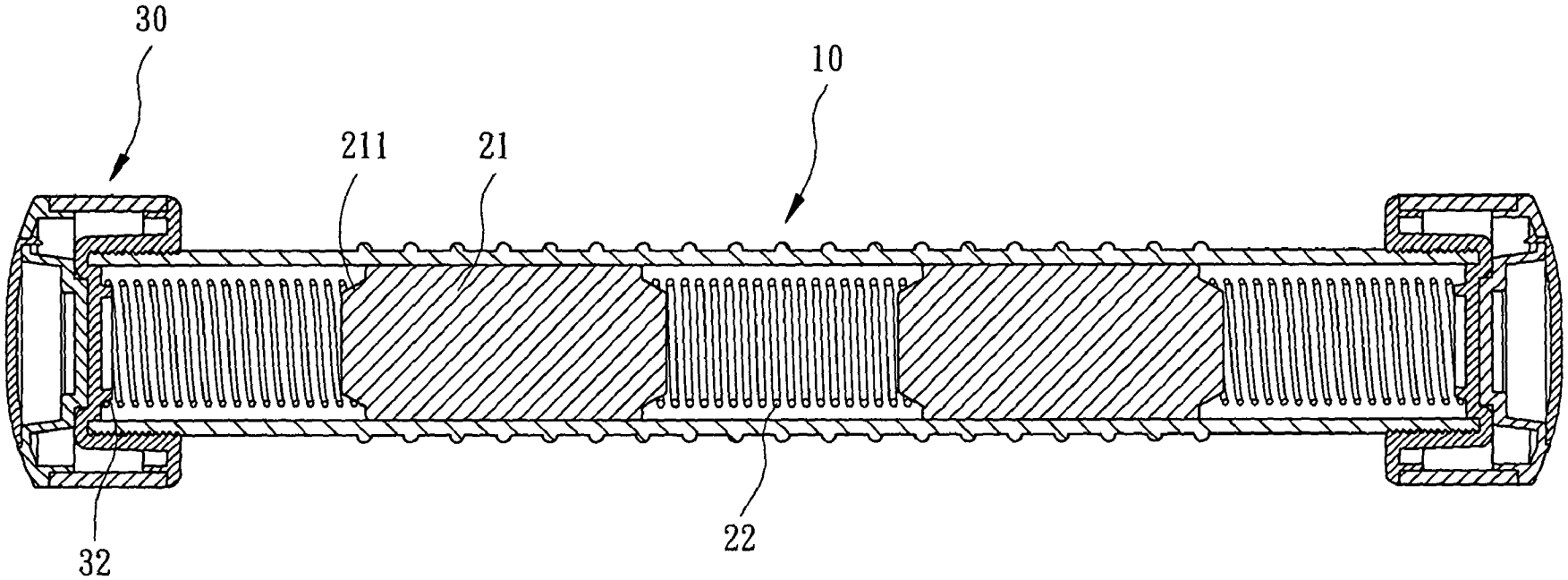
FIG. 3 is a cross-sectional view of the dumbbell shown in FIG. 1.

Referring to FIGS. 2 and 3, the weight unit 20 includes weights 21 and springs 22 alternately arranged within the handle 10. Each of the caps 30 is located against a related one of the springs 22 so that the weights 21 do not hit the caps 30 axially. To this end, the amount of the weights 21 is smaller than the amount of the springs 22 by one.

The weight of each of the weights 21 is a designer's choice. The diameter of each of the weight 21 is substantially identical to the diameter of the handle 11 on the inside so that the weights 21 do not hit the handle 10 transversely. Each of the weights 21 includes an axial extension 211 formed at each end. Each of the axial extensions 211 of each of the weights 21 is inserted in an end of a related one of the springs 22 for positioning the springs 22.

Each of the caps 30 includes a thread 31 and an axial protrusion 32 formed on the inside. The thread 31 of each of the caps 30 is engaged with a related one of the threads 11 of the handle 10. The axial protrusion 32 of each of the caps 30 is inserted in an end of a related one of the springs 22 for positioning the springs 22.

Figure 4:
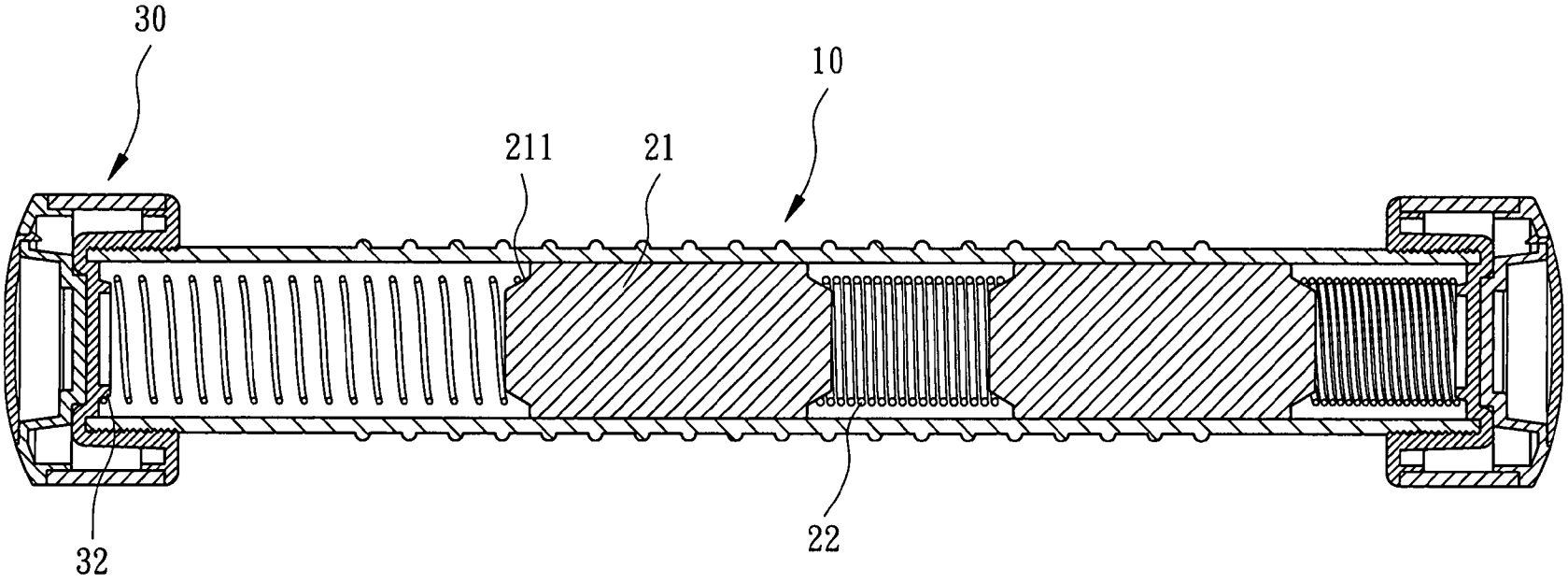
FIG. 4 is a cross-sectional view of the dumbbell in another position than shown in FIG. 3.

Referring to FIG. 4, the weights 21 are moved axially within the handle 10 when the dumbbell is used by a person. The weights 21 do not hit one another and the caps 30 because of the use of the springs 22. Therefore, the person does not make annoying noise.

Figure 5:
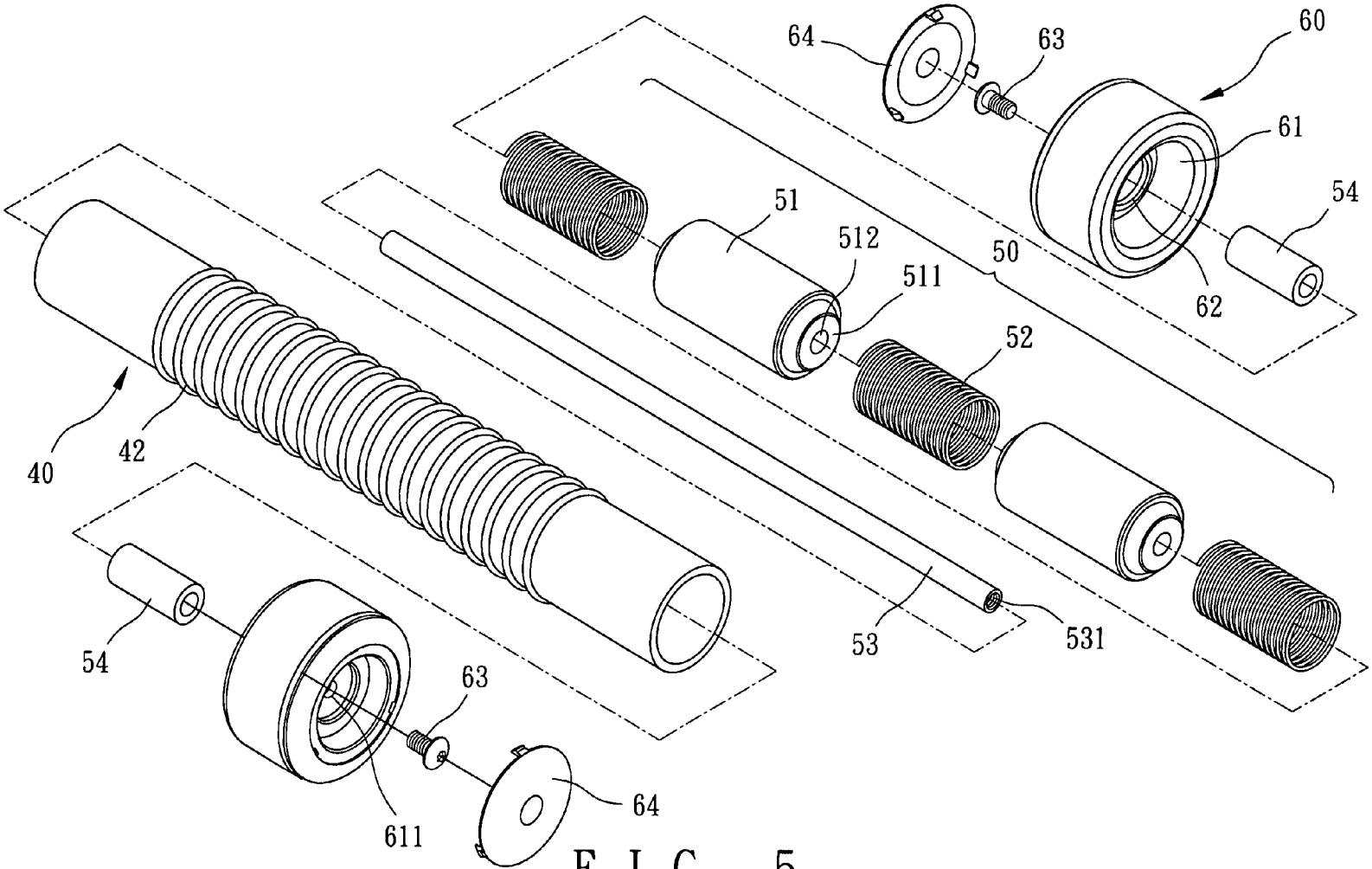
FIG. 5 is a perspective view of a dumbbell according to the second embodiment of the present invention.
Figure 6:
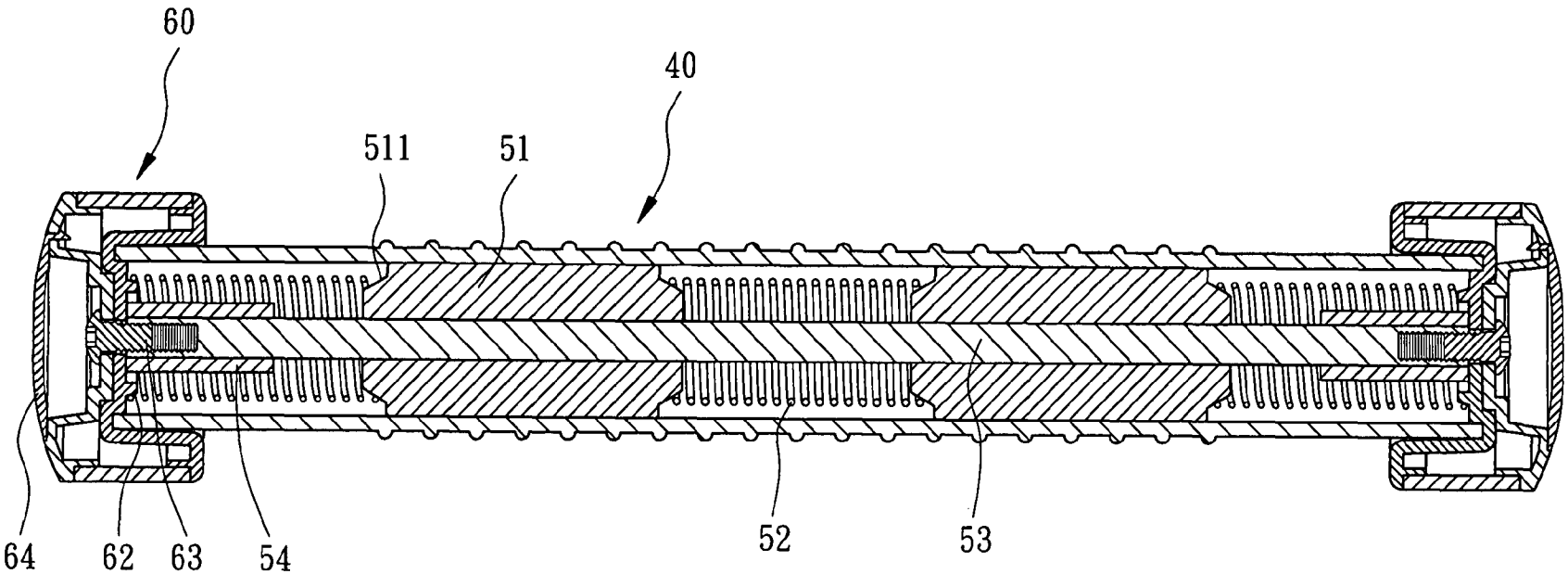
FIG. 6 is an exploded view of the dumbbell shown in FIG. 5.

Referring to FIGS. 5 and 6, a dumbbell includes a handle 40, a weight unit 50 and two caps 60 to retain the weight unit 50 within the handle 40 according to a second embodiment of the present invention. The handle 40 is hollow inside and formed with ribs 42 on the outside.

The weight unit 50 includes weights 51, springs 52, a rod 53 and two sleeves 54. Each of the weights 51 includes an axial extension 511 formed at each end and a tunnel 512 defined therein throughout the entire length. The rod 53 includes a screw hole 531 defined in each end. Each of the sleeves 54 is made of a soft material such as rubber.

The weights 51 and the springs 52 are alternately arranged within the handle 40. Each of the axial extensions 511 of each of the weights 51 is inserted in an end of a related one of the springs 52 for positioning the springs 52. Each of the caps 60 is located against a related one of the springs 52 so that the weights 51 do not hit the caps 60 axially. Each of the sleeves 54 is located against a related one of the caps 60 for further buffering between the weights 51 and the caps 60. The rod 53 is inserted through the tunnels 512 of the weights 51 so that the weights 51 do not hit the handle 40 transversely. Moreover, the rod 53 is inserted through the springs 52 and the sleeves 54.

Each of the caps 60 includes a cavity 61 defined in a side and an axial protrusion 62 formed on the side. The axial protrusion 62 of each of the caps 62 is inserted in an end of a related one of the springs 52 for positioning the springs 52. A screw 63 is driven into each of the screw holes 531 of the rod 53 through a central aperture 611 defined in a related one of the caps 60. A cover 64 is attached to each of the caps 60, thus protectively covering a related one of the screws 63.

Figure 7:
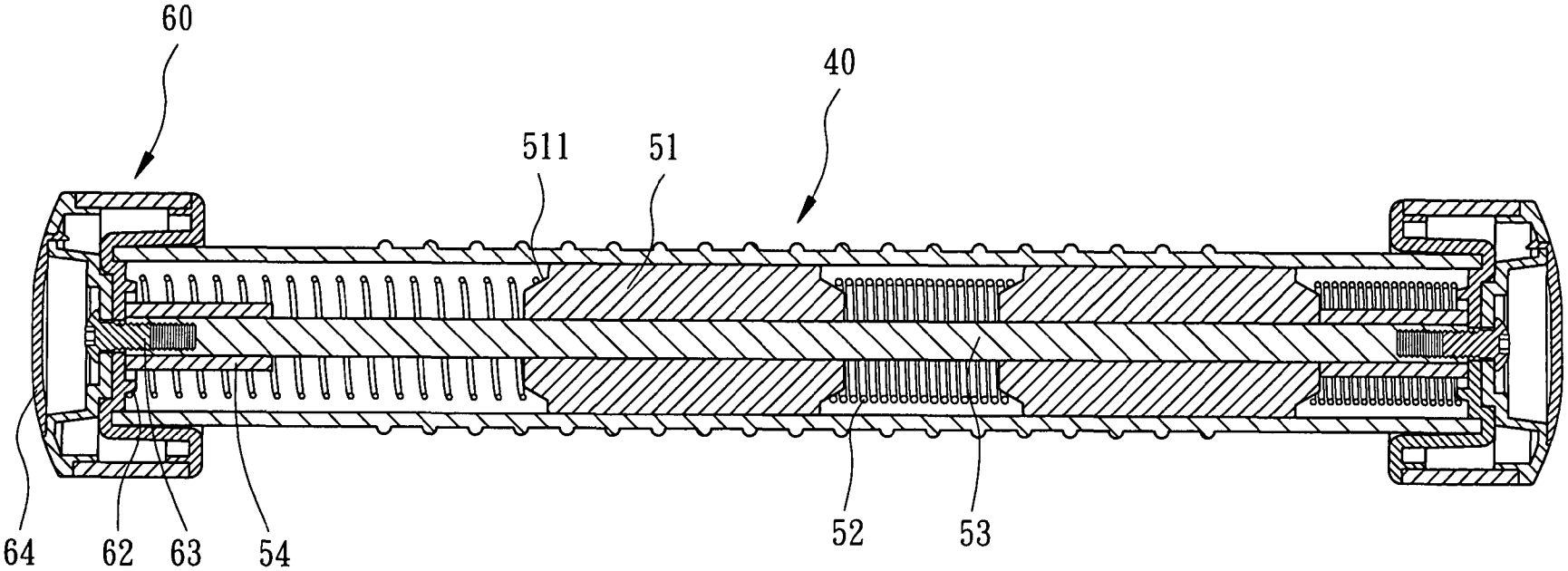
FIG. 7 is a cross-sectional view of the dumbbell shown in FIG. 5.

Referring to FIG. 7, the weights 51 tend to move axially within the handle 40. The weights 51 do not hit one another and the caps 60 because of the use of the springs 52 and the sleeves 54.

Figure 8:
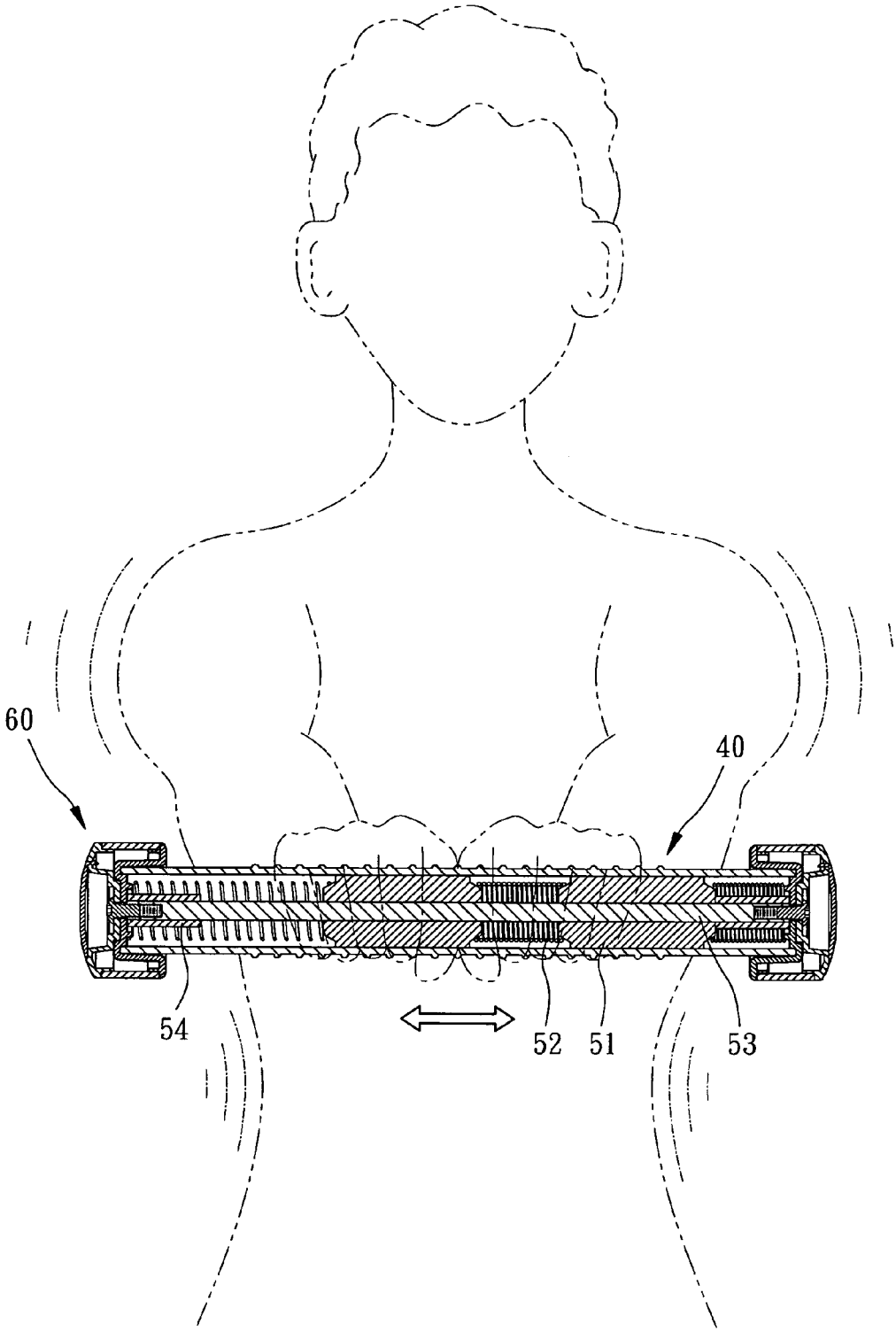
FIG. 8 is a front view of a person using the dumbbell shown in FIG. 7.

Referring to FIG. 8, a person horizontally moves the dumbbell to and fro. The weights 51 are moved to and fro within the handle 40 as some of the springs 52 expand while the other springs 52 shrink.

Figure 9:
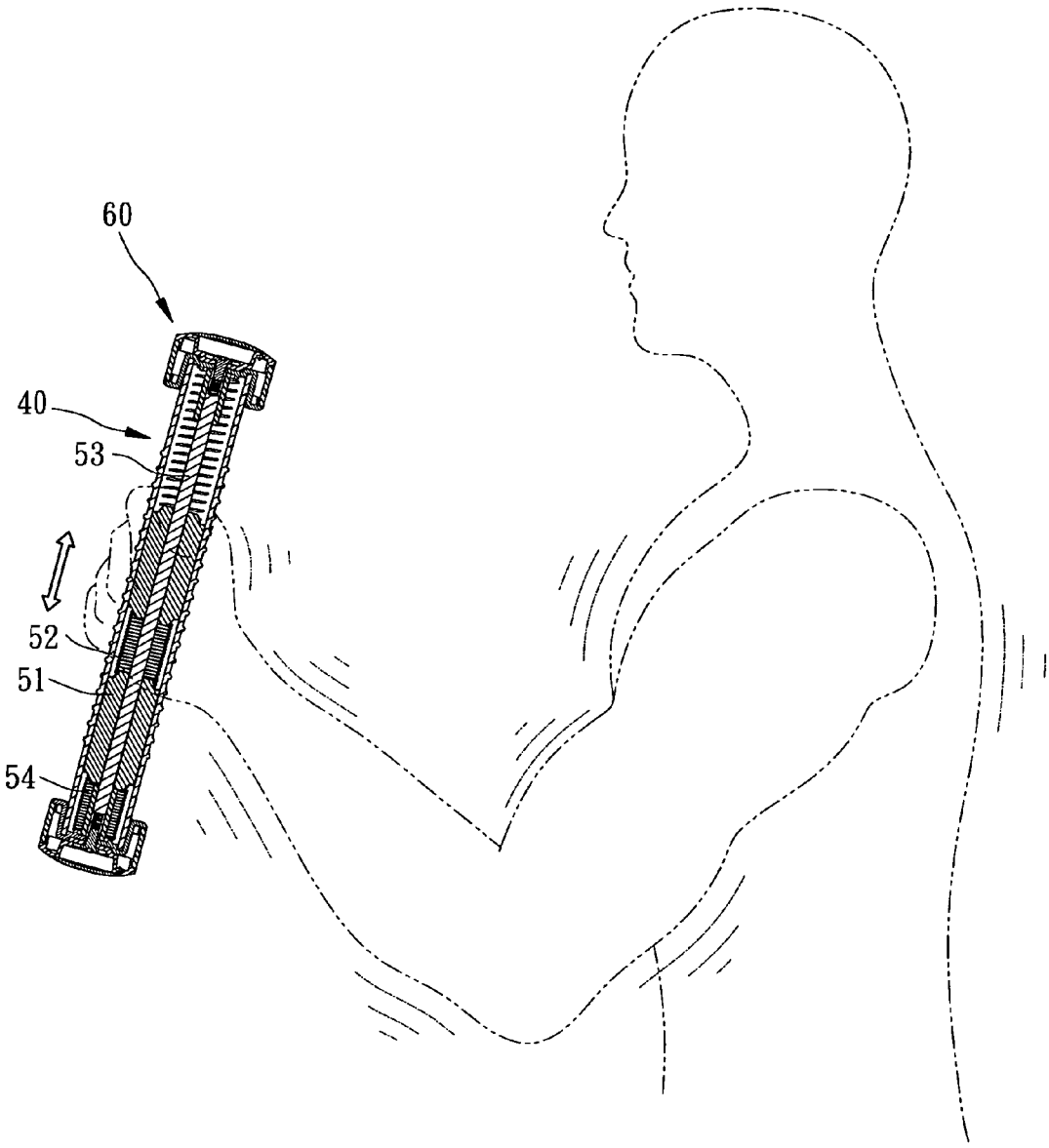
FIG. 9 is side view of a person using the dumbbell shown in FIG. 7.

Referring to FIG. 9, the person vertically moves the dumbbell to and fro. The weights 51 are moved to and fro within the handle 40 as some of the springs 52 expand while the other springs 52 shrink.

Figure 10:
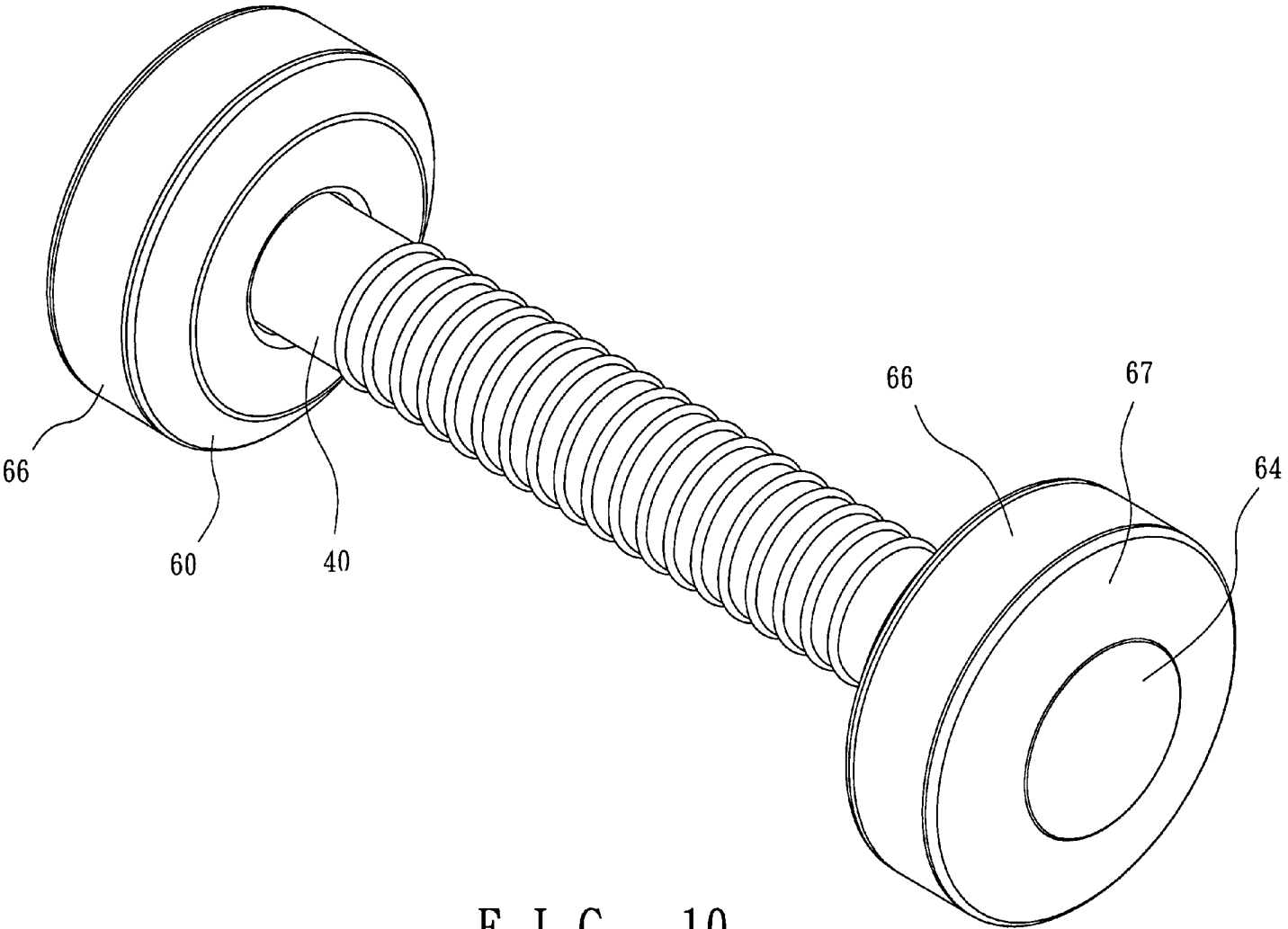
FIG. 10 is a perspective view of a dumbbell according to the third embodiment of the present invention.
Figure 11:
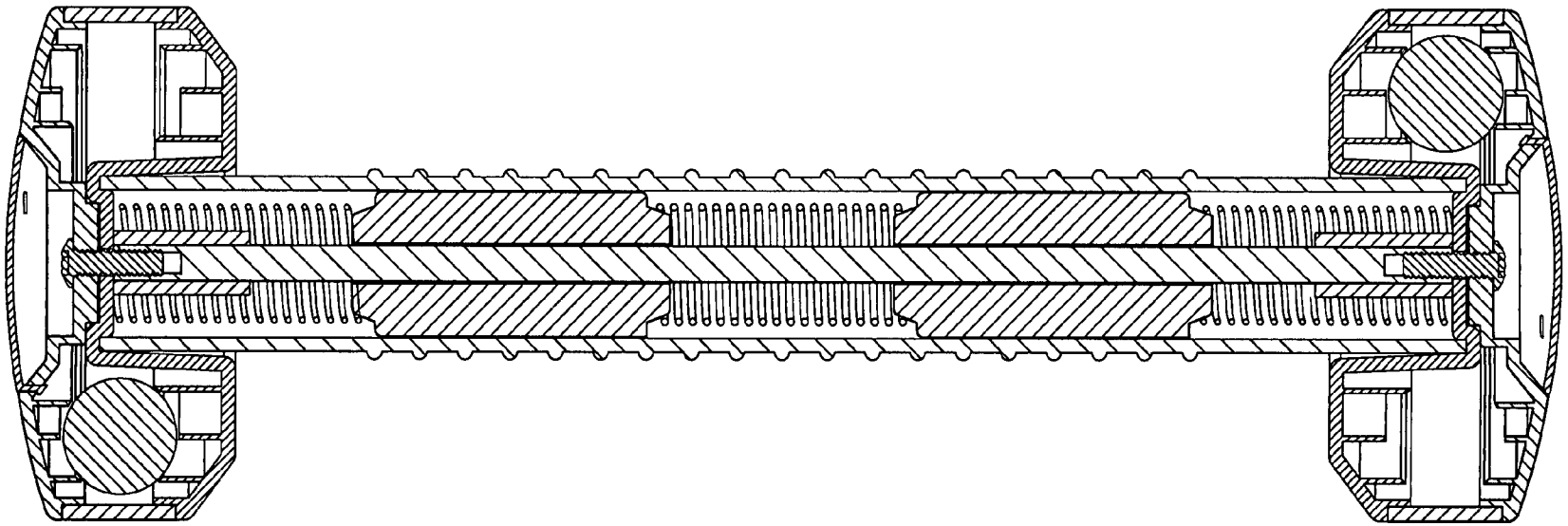
FIG. 11 is a cross-sectional view of the dumbbell shown in FIG. 10.
Figure 12:
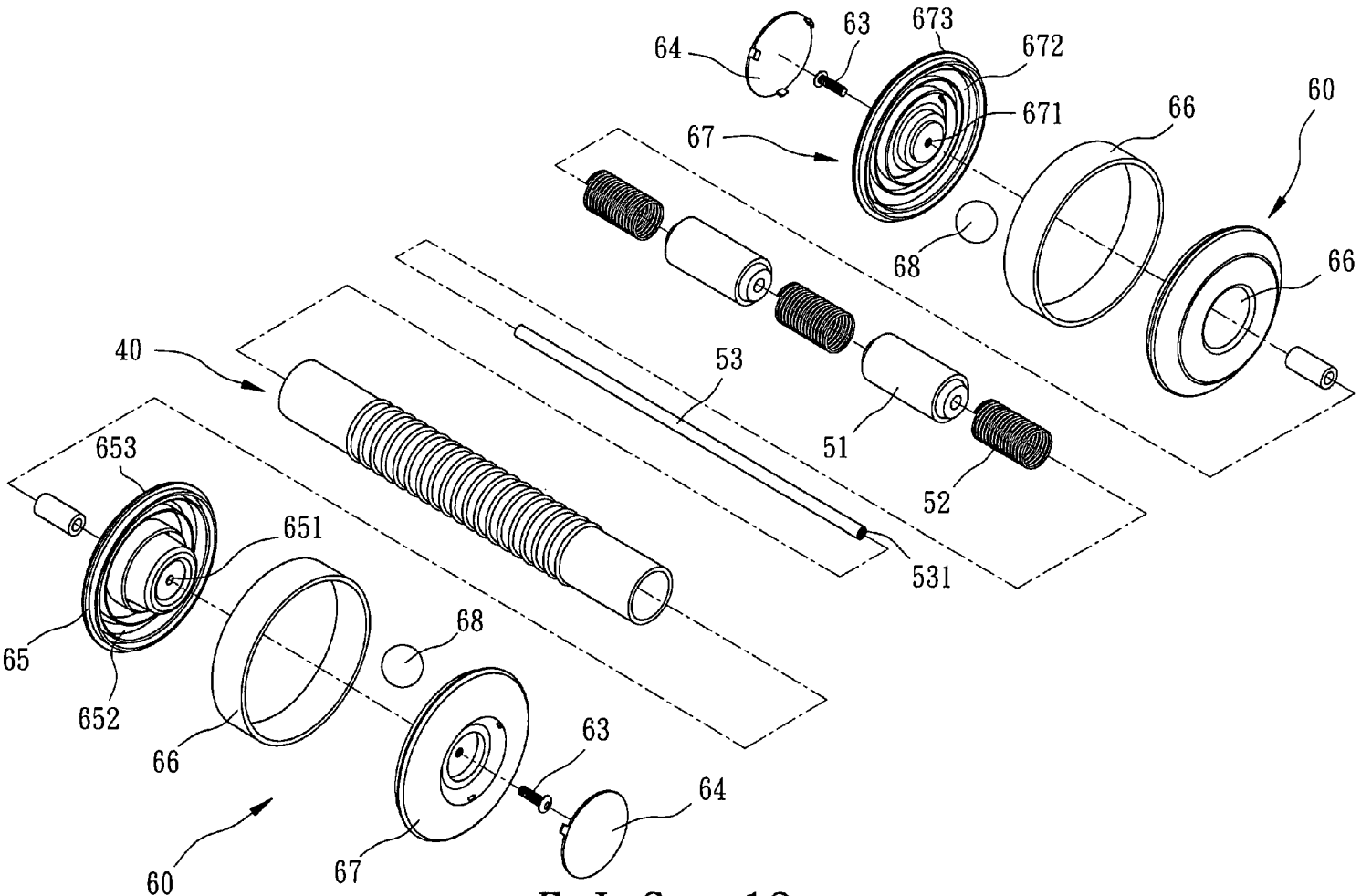
FIG. 12 is an exploded view of the dumbbell shown in FIG. 10.

Referring to FIGS. 10 and 12, there is shown a dumbbell according to a third embodiment of the present invention. The third embodiment is like the second embodiment except that each of the caps 60 includes a ring 66 sandwiched between two discs 65 and 67 instead of a one-piece element. The disc 65 includes an aperture 651 centrally defined therein, a groove 652 defined therein around the aperture 651 and a flange 653 circumferentially formed thereon. Similarly, the disc 67 includes an aperture 671 centrally defined therein, a groove 652 defined therein around the aperture 671 and a flange 673 circumferentially formed thereon. The ring 66 includes an edge abutted against the flange 653 of the disc 65 and another edge abutted against the flange 673 of the disc 67. Thus, the grooves 652 and 672 together become an annular space for containing a vibration element 68. The vibration element 68 is a ball for example. The ball 68 is movable along the annular space. Thus, a person can exercise by rolling the ball 68 along the annular space in each of the caps 60. Each of the screws 63 is driven in a related one of the screw holes 531 through the apertures 651 and 671 of a related one of the caps 60.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A dumbbell comprising:

a handle;

a weight unit comprising weights and springs alternately arranged within the handle;

two caps for retaining the weight unit within the handle, wherein each of the caps is located against a related one of the springs so that the weights do not hit the handle axially; the weight unit comprising a rod inserted through the weights and the springs and connected to the caps, each of the caps including an annular space defined therein; and two balls respectively received in the annular space in a corresponding one of the two caps.

2. The dumbbell according to claim 1, wherein the handle comprises ribs formed thereon for skid-proof purposes.

3. The dumbbell according to claim 1, wherein the handle comprises two threaded formed thereon, and each of the caps comprise a thread formed on an internal side thereon and engaged with a related one of the threads of the handle.

4. The dumbbell according to claim 1, wherein each of the weights comprises an axial extension at each end thereof and inserted in an end of a related one of the springs.

5. The dumbbell according to claim 1, wherein each of the caps comprises an axial extension formed on a side thereof and inserted in an end of a related one of the springs.

6. The dumbbell according to claim 1, comprising two screws each driven in an end of the rod through a related one of the caps.

7. The dumbbell according to claim 6, wherein the rod comprises two screw holes for receiving the screws.

8. The dumbbell according to claim 7 comprising two covers each connected to a related one of the caps to protectively cover a related one of the screws.

9. The dumbbell according to claim 6, wherein each of the caps comprises an aperture via which a related one of he screws is inserted.

10. The dumbbell according to claim 1, comprising two sleeves provided on the rod so that each of the sleeves is located against a related one of the caps for further buffering between the weight and cap.

11. The dumbbell according to claim 1, wherein each of the caps comprises two discs and a ring sandwiched between the discs so that the annular space is defined by the discs and the ring.

12. The dumbbell according to claim 11, wherein each of the discs comprises a groove defined therein so that the grooves of the discs together become the annular space.

13. The dumbbell according to claim 11, wherein each of discs comprises a flange abutted against an edge of the ring.

* * * * *